US006330741B1

(12) United States Patent
Wright et al.

(10) Patent No.: US 6,330,741 B1
(45) Date of Patent: Dec. 18, 2001

(54) METHOD OF SHRINK FITTING CRYSTALLINE SAPPHIRE

(75) Inventors: Dexter V. Wright, Pittsburgh; Robert Weinert, Monroeville, both of PA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/413,943

(22) Filed: Oct. 5, 1999

(51) Int. Cl.[7] ..... H01Q 13/00

(52) U.S. Cl. ..... 29/600; 333/182; 333/206; 333/207

(58) Field of Search ..... 29/600; 333/182, 333/206, 207

(56) References Cited

U.S. PATENT DOCUMENTS 4,276,525 * 6/1981 Nishikawa et al. .
4,506,241 * 3/1985 Makimoto et al. ..... 29/600
5,500,995 * 3/1996 Palmieri et al. ..... 29/600

* cited by examiner

*Primary Examiner*—Carl J. Arbes
(74) *Attorney, Agent, or Firm*—John J. Karasek; Charles J. Stockstill

(57) ABSTRACT

The technique of shrink fitting technique described herein is used to bond crystalline sapphire pieces to each other, in particular, the shrink fitting of a c-axis sapphire post to a c-axis sapphire puck. The sapphire dielectric resonator is used successfully from cryogenic temperatures to well above room temperature. The shrink fit bond yields a high strength and rigid attachment which can withstand high shock levels. Since there is no loss, the resonator Q is a maximum, being limited by the sapphire loss tangent only.

2 Claims, 2 Drawing Sheets

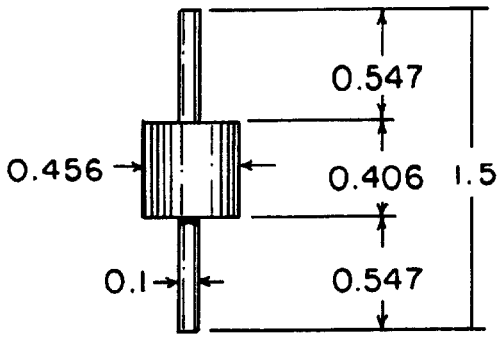
FIG. 1a
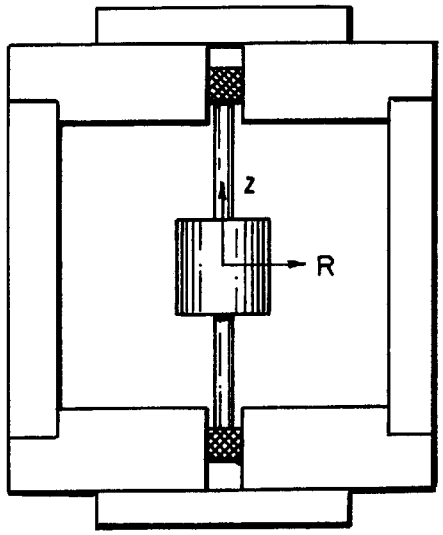
FIG. 1b
FIG. 2a
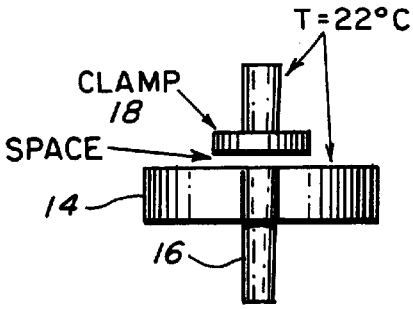
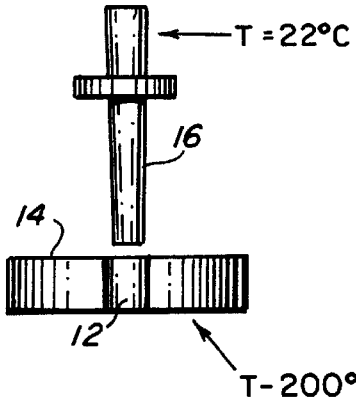
FIG. 2c
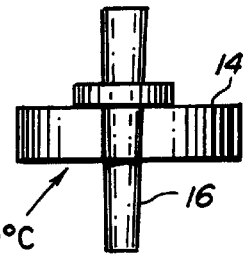
FIG. 2b

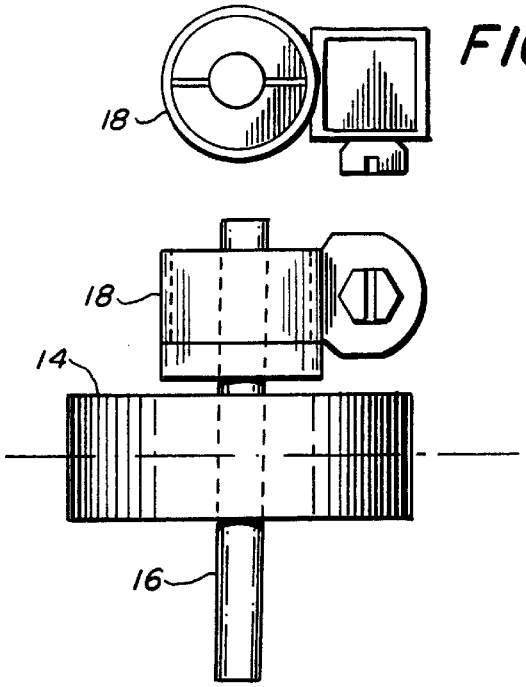
FIG. 3b
FIG. 3a
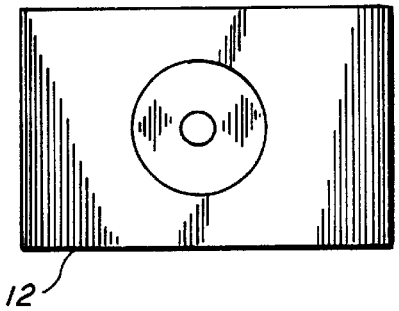
FIG. 3d
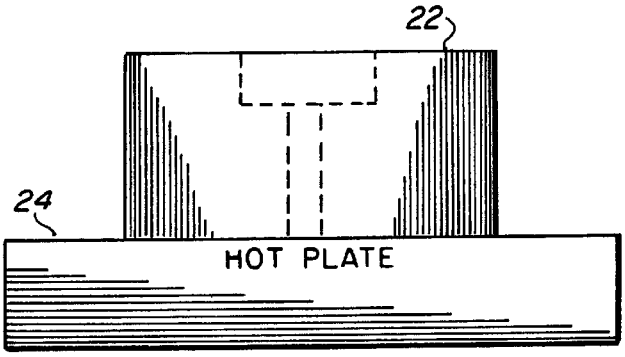
FIG. 3c
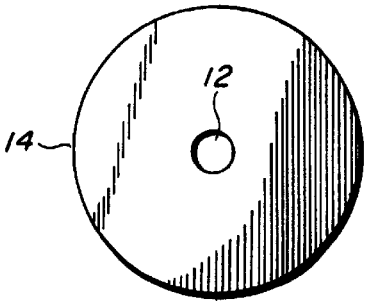
FIG. 4b
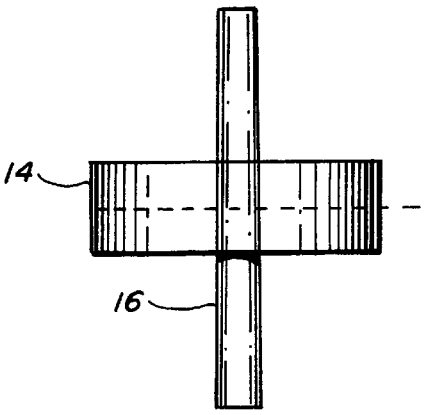
FIG. 4a

METHOD OF SHRINK FITTING CRYSTALLINE SAPPHIRE

BACKGROUND OF THE INVENTION

1. Field of the Invention

This disclosure is related to applications of very high Q cryogenic dielectric resonators at X-band to the development of ultra low phase noise phase noise sources for radar.

2. Description of the Related Art

X-hand dielectric resonators using low order $TE_{On}$ modes and higher order whispering gallery modes of a sapphire puck are being developed to work at temperatures ranging from room temperature to cryogenic temperatures. Because the loss tangent of sapphire varies as the fifth power of temperature, lowering the operating temperature to ~77 K (liquid nitrogen) allows Q values of ~$10^6$ (low order modes), and >$10^7$ (high order modes) to be realized. To realize the full Q potential at cryogenic temperatures, low loss puck support posts must contact the puck at the center of the flat faces. The resonant electric field amplitudes in and around the puck near the z axis are very small and a post aligned along the z axis will have minimal effect on resonant frequency and resonant Q.

One of our earlier spindle (post) mount sapphire resonators was made out of a single piece of c-axis sapphire. The solid sapphire-puck is contained within a metal cavity as shown in FIGS. 1*a* and 1*b* and was designed for $TE_{02}$ operation at 10 Ghz. The measured Q of this resonator at 77 K was $0.6\times10^6$, where we expected $1.0\times10^6$. The Q degradation was due to a low quality finish of the flat faces of the puck. These faces could not be properly finished with the spindle in the way. For the next phase of the STALO program we ordered sapphire puck and separated post sets where all faces of the puck had a high quality finish. These pucks were dimensioned for higher order whispering gallery mode operation at X-band because the Q requirements ($10^7$) of this phase of the program could not be satisfied with $TE_{On}$ modes.

BRIEF SUMMARY OF THE INVENTION

The object of this invention is to provide a technique of bonding crystalline sapphire pieces together.

The technique of shrink fitting technique described herein is used to bond crystalline sapphire pieces to each other, in particular, the shrink fitting of a c-axis sapphire post to a c-axis sapphire puck. The sapphire dielectric resonator is used successfully from cryogenic temperatures to well above room temperature. The shrink fit bond yields a high strength and rigid attachment which can withstand high shock levels. Since there is no loss, the resonator Q is a maximum, being limited by the sapphire loss tangent only.

BRIEF DESCRIPTION OF THE DRAWINGS

FIG. 1*a* shows $TE_{On}$ mode sapphire dielectric resonator one piece sapphire puck and post.

FIG. 1*b* shows $TE_{On}$ mode sapphire dielectric resonator in a copper enclosure.

FIG. 2*a* shows two pieces of the device put together at room temperature where the split block clamp is spaced off the puck.

FIG. 2*b* shows the puck and post installation where the collar is at a temperature of ~200° C. where the hand held clamped sapphire post is at room temperature.

FIG. 2*c* shows two pieces of sapphire puck and tapered post put together, shrink fit sapphire puck and post where shrink fit is good for all temperatures.

FIG. 3*a* shows a side view of the split block clamp, sapphire post, and sapphire puck.

FIG. 3*b* shows a top view of the split block clamp.

FIG. 3*c* shows a side view of the brass block holding the puck on a hot plate.

FIG. 3*d* shows a top view of the brass block.

FIG. 4*a* shows a side view of a c-axis puck-c-axis post assembly.

FIG. 4*b* shows a top view of a c-axis puck-c-axis post assembly.

DETAILED DESCRIPTION OF THE INVENTION

The shrink fitting process is shown schematically in FIGS. 2*a*, 2*b* and 2*c*. The tapered hole 12 is core drilled into the sapphire puck 14 after the puck 14 is polished to precise dimensions. The separately made tapered sapphire post 16 is then used to lap the tapered hole 12 to ensure a large contact area between the two pieces 14 and 16. FIG. 2*a* shows the two pieces put together at room temperature (assuming 22° C.) where the split block clamp 18, Torlon 5030, made by the Polymer Corporation, is spaced off the puck 14 surface, by a predetermined amount, with a feeler gauge. FIG. 2*b* shows the puck 14 heated top a temperature at ~200° C. by a hot plate (not shown) while the hand held clamped sapphire post 16 is at room temperature. The post 16 is then quickly lowered into the hole 12 only as far as the clamp 18 allows and held down for about 10 seconds. At this point, FIG. 2*c*, the hot plate (not shown) is turned off, the sapphires 14 and 16 are allowed to cool, and the clamp 18 is removed. The clamp 18 and sapphire puck 14 and post 16 are shown in more detail in FIGS. 3*a* and 3*b* and the brass block 22 used to hold the puck on the hot plate 24 is shown in FIG. 3*c* and *d*.

A uniform sapphire post 16 and hole 12 diameter would have to be machined to an unattainable tolerance lever in order to limit the circumferential tensile stress in the bonded sapphire pieces 14 and 16. Shrink fitting the tapered sapphire rod 16 into a tapered hole 12 relaxes diameter tolerances and converts the safe tensile stress range into a range of axial translations of the rod 16. The axial translation is limited by the clamp 18, FIG. 2*a*. For example, we calculated that a 20 mil clamp 18 spacing leads to a circumferential stress in the sapphire puck 14 of less than 25 ksi. The sapphire vendor specifies the safe tensile stress range as 40 to 60 ksi. Using the tapered post 16 to lap the tapered hole 12 ensures a large contact area between the two pieces. This lapping process is not available when using uniform diameter posts 16 and holes 12.

This process was used on seven puck-post 14 and 16, respectively, sets where the clamp 18 space was varied between 10 and 20 mils. Good contact was achieved over more than 80% of the contact area (by optical inspection) for all seven of the sets. The puck-post 14 and 16, respectively, sets were cycled between 20 K and 300 K with no adverse effect on resonator Q. The post 16 remains tight in the puck 14 and no chipping occurred. We calculate, for a post 16 diameter to puck 14 diameter ratio less than 0.15, the seventh order whispering gallery mode unloaded Q ($Q_u$) to be $30\times10^6$ (F=11.1 Ghz, T=77 K). For the tapered post 16 and puck 14 shown in FIGS. 4*a* and 4*b* the average post 16 diameter to puck 14 diameter is ~0.14 and with a measured $Q_u=30\times10^6$. A post/puck 14 and 16, respectively, diameter ratio of <0.15 does not affect frequency or the spurious mode free window. The fact that measurements agree with calculations indicates that the bond stress is localized to the relatively unimportant (electrically) central region.

Other brittle materials, such as quartz, and diamond, may be bonded into a structure where the bond must withstand large temperature variations (~0 K to near the melting point of the materials involved). Knowing the elastic properties and thermal expansion properties of the materials to be bonded allows for calculating safety margins and bond strength. If a metal is to be bonded to a brittle material then the temperature expansion coefficients must be well matched over the operating temperature range.

Shrink fitting sapphire to sapphire as described in this disclosure allowed our ultra high Q resonator to perform to its full potential and the use of tapered fitting parts led to an easy fabrication, 100% yield process.

Although the invention has been described in relation to an exemplary embodiment thereof, it will be understood by those skilled in the art that still other variations and modifications can be affected in the preferred embodiment without detracting from the scope and spirit of the invention as described in the claims.

What is claimed:

1. A technique for shrink fitting a post mount sapphire resonator onto a single piece of c-axis sapphire comprising:

a tapered post mount sapphire held at room temperature;

a single piece c-axis sapphire puck at room temperature having a tapered hole of similar dimension of taper as that of the tapered post mount sapphire; predetermined diameter;

a split block clamp placed around the tapered post mount to determine the amount said post is inserted into said puck; and said post at room temperature being inserted into the hole in said heated puck to the depth allowed by the clamp whereupon the post and puck temperatures are allowed to equalize.

2. A method of shrink fitting a post mount sapphire resonator onto a single piece of c-axis sapphire puck, comprising the steps of:

tapering a post mount sapphire resonator to a predetermined taper;

drilling a tapered hole in the single piece c-axis sapphire puck equal to the taper of the post mount sapphire resonator;

placing a split block clamp placed around the tapered post mount sapphire to determine the depth said post may be inserted into the c-axis sapphire puck, said post and puck at room temperature;

heating said puck to a predetermined temperature;

inserting said tapered post mount sapphire at room temperature into the tapered hole in said heated c-axis sapphire puck to the depth allowed by the clamp;

allowing the post and puck temperatures to equalize; and removing the clamp.

* * * * *